US006699323B2

(12) United States Patent
Tacchi et al.

(10) Patent No.: US 6,699,323 B2
(45) Date of Patent: Mar. 2, 2004

(54) SPRAY GLUING UNIT

(75) Inventors: Alver Tacchi, Bologna (IT); Silvano Boriani, Bologna (IT); Fausto Negrini, Castelfranco Emilia (IT); Alessandro Minarelli, Bazzano (IT)

(73) Assignee: G.D S.p.A., Bologna (IT)

( * ) Notice: Subject to any disclaimer, the term of this patent is extended or adjusted under 35 U.S.C. 154(b) by 33 days.

(21) Appl. No.: 10/067,872

(22) Filed: Feb. 8, 2002

(65) Prior Publication Data

US 2002/0108562 A1 Aug. 15, 2002

(30) Foreign Application Priority Data

Feb. 14, 2001 (IT) ..... BO2001A0078

(51) Int. Cl.[7] ..... B05C 15/02

(52) U.S. Cl. ..... 118/302; 118/501; 53/370.3; 239/106; 239/115

(58) Field of Search ..... 118/302, 501; 156/578, 389; 53/370.3, 228, 377.4; 239/106, 114, 115, 533.13, 602

(56) References Cited

U.S. PATENT DOCUMENTS

| | | | | |
|---|---|---|---|---|
| 3,351,292 A | | 11/1967 | Stuart | |
| 4,259,372 A | | 3/1981 | Eddy | |
| 4,702,195 A | * | 10/1987 | Thielmann | 118/72 |
| 4,704,308 A | | 11/1987 | Maneke et al. | |
| 5,477,989 A | * | 12/1995 | Maas et al. | 222/153.1 |
| 5,647,411 A | | 7/1997 | Koppe et al. | |
| 5,683,753 A | | 11/1997 | Yamaguchi et al. | |
| 6,463,716 B1 | * | 10/2002 | Focke et al. | 53/370.3 |

FOREIGN PATENT DOCUMENTS

| | | |
|---|---|---|
| DE | 39 08 453 | 9/1990 |
| DE | 199 36 670 | 2/2001 |
| EP | 0 911 085 A1 | 4/1999 |
| EP | 1 099 634 A1 | 5/2001 |

* cited by examiner

*Primary Examiner*—Richard Crispino
*Assistant Examiner*—Yewebdar T. Tadesse
(74) *Attorney, Agent, or Firm*—Davidson Berquist Klima & Jackson, LLP

(57) ABSTRACT

A spray gluing unit in a machine for wrapping products advancing along a pass line comprises a gluer equipped with a nozzle having an outlet from which adhesive is directed onto a wrapping material enveloping the products, and a cleaning station equipped with a first movable member carrying a scraper blade and a wetting pad to which silicone oil is supplied; the scraper blade and the wetting pad are designed to interact with a flat surface of the gluer and with an end face of the outlet, occupying substantially the same plane, so as to remove any residual adhesive from the gluer and keep the outlet moistened.

20 Claims, 4 Drawing Sheets

SPRAY GLUING UNIT

BACKGROUND OF THE INVENTION

The present invention relates to a spray gluing unit.

The invention finds application to advantage in the art field of packaging machines, and packers in particular, to which explicit reference will be made in the following specification albeit implying no limitation in scope.

The need exists in such machines for an adhesive substance to be applied to predetermined portions of paper material, for example flat diecut blanks folded ultimately into containers or packets, or to labels that will be affixed to such containers or packets.

It is standard practice in machines of the type in question to employ spray gluing units disposed facing a pass line, along which sheets for gluing are caused to advance, each such unit comprising at least one spray gluer with a nozzle connected to a circuit supplying the adhesive substance.

Spray gluing units of the aforementioned type betray the drawback that the nozzles need servicing and cleaning at frequent intervals, due especially to the fact that traces of the adhesive substance tend to dry on the nozzle tips whenever a temporary and/or prolonged stoppage occurs during operation of the machine.

In particular, the nozzles employed are furnished generally with outlets having tips of conical or frustopyramidal geometry, and it is on the outer surfaces of these tips that the sprayed adhesive becomes lodged and clings, due to its viscosity, forming encrustations and residues that compromise the correct operation of the gluer especially when the residues in question have dried.

The accumulated residues need to be removed, and accordingly the prior art embraces gluing units in which the nozzle is capable of movement between an operating position, in which the adhesive substance is sprayed onto the aforementioned sheets, and a cleaning station where the nozzle is subjected to the action of means serving to remove any deposits of the adhesive substance that may have dried, or simply to prevent the deposits from drying.

Alternatively, in certain types of machine, the means by which the residues of adhesive are removed can themselves be made capable of movement and thus offered to the nozzle, which remains substantially motionless in the operating position, although the cleaning operation is essentially no different.

The operation of cleaning the nozzle is in any event a difficult one. Owing to the aforementioned geometry of the nozzle, which presents sharp corner edges, cleaning means of mechanical type will tend to be particularly complex, whereas cleaning means of hydraulic type, using jets, require particularly high operating pressures that can produce overspray and cause the cleaning liquid to splash undesirably on other parts of the machine.

The object of the present invention is to provide a gluing unit unaffected by the drawbacks mentioned above, while being functional, economical and of compact dimensions.

SUMMARY OF THE INVENTION

The stated object is realized in a spray gluing unit according to the present invention, applicable to a product packaging machine, comprising at least one spray gluer equipped with a nozzle having a respective outlet from which an adhesive substance is directed at a wrapping material enveloping the products, also means by which to clean the gluing nozzle, the gluing nozzle and the cleaning means being capable of movement one relative to another for the purpose of cleaning the outlet.

To advantage, the spray gluer presents a surface surrounding and joined to an end face of the nozzle outlet, and cleaning means comprise means capable of interacting with the end face of the outlet and with the surrounding surface at least during the relative movement of the cleaning means and the nozzle, in such a way as to remove any residues of the adhesive substance.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
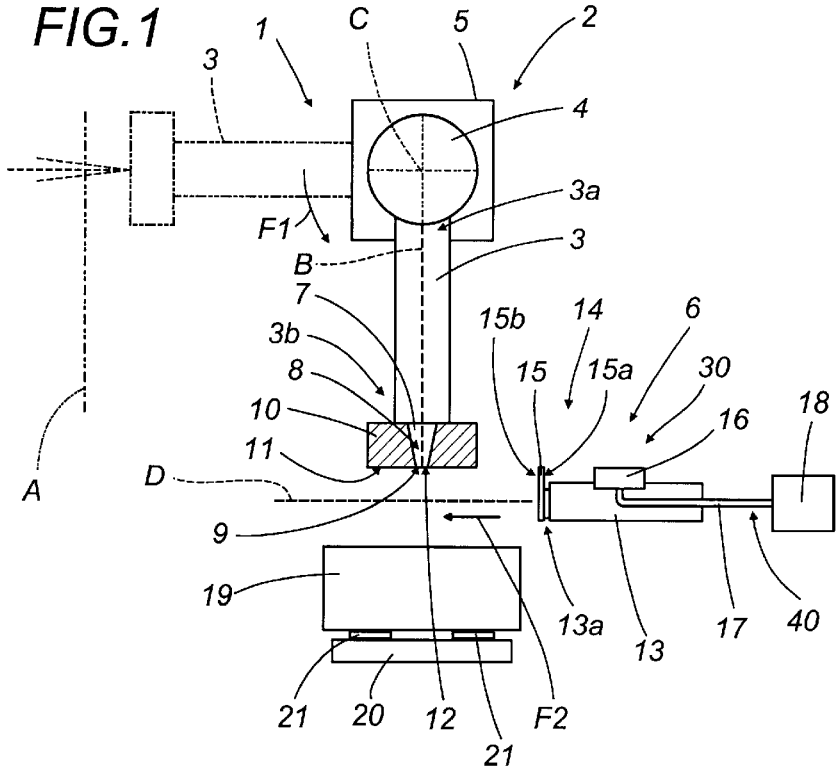
FIG. 1 is a schematic illustration of the gluing unit according to the present invention.

Referring to FIG. 1 of the drawings, 1 denotes the gluer of a spray gluing unit 2.

In an active gluing position indicated by phantom lines in FIG. 1, the gluer 1 is disposed facing a conveying line (not illustrated) along which sheets of paper material (not illustrated) requiring the application of an adhesive substance are caused to advance through a packaging machine, likewise not illustrated, in a direction denoted A.

The gluer 1 comprises a cylindrical body 3 of which the longitudinal axis is denoted B, and of which a first end 3*a* is associated rigidly with a rotary member 4 mounted to a support element 5, this associated rigidly in turn with the packaging machine (not illustrated). The rotary member 4 is driven pivotably about a respective axis C by means of familiar type, not illustrated, in such a way as to rotate the gluer 1 between the aforementioned gluing position, facing the conveying line, and an at-rest position facing a cleaning station 6.

The gluer 1 also comprises a nozzle 7, located at a second end 3*b* of the cylindrical body 3 opposite to the first end 3*a*, comprising a relative outlet 8 from which the adhesive substance is projected.

The nozzle outlet 8 presents an end face 9 that is directed toward the cleaning station 6 whenever the gluer 1 occupies the at-rest position.

Also forming part of the gluer 1 is a cylindrical cap 10 coupled with and surrounding the nozzle 7, presenting a flat surface 11 disposed perpendicular to the aforementioned longitudinal axis B, which occupies substantially the same plane as the end face 9 of the nozzle outlet 8 and affords a hole 12 through which the adhesive substance is projected into space from the tip of the nozzle.

The cleaning station 6 includes a first member 13 capable of movement along a path D substantially perpendicular to the longitudinal axis B of the body 3, as viewed with the gluer 1 occupying the at-rest position, between a first non-operating position distanced from the gluer 1 and a second operating position of proximity to the gluer 1.

The first movable member 13 is furnished at a first end 13*a*, directed toward the gluer 1, with means 14 serving to remove residues of the adhesive substance from the selfsame gluer 1.

In the preferred embodiment of FIGS. 1 to 5, such removal means 14 advantageously comprise a scraper blade 15 of flexible plastic material such as will engage both the end face 9 of the outlet 8 and the flat surface 11 of the cap 10 during the passage of the first movable member 13 along the aforementioned path D.

Likewise to advantage, the plastic material from which the scraper blade 15 is fashioned will be a non-stick material, for example Arnite (registered trademark), to which the adhesive substance does not cling.

The scraper blade 15 presents an inside face 15*a* directed toward the first movable member 13 and an outside face 15*b* on the opposite side to the inside face.

Also mounted to the movable member 13, alongside the removal means 14, is a wetting pad 16 designed to engage the nozzle outlet 8 sequentially with the scraper blade 15 to the end of maintaining a given level of moistness at the outlet 8.

The wetting pad 16 carried by the first movable member 13 receives a fluid substance, for example silicone oil, supplied by way of a feed duct 17 connected to a device 18 represented schematically as a block in the drawings, by which the fluid is atomized in a stream of gas directed to the pad 16.

As discernible from the drawings, the cleaning station 6 also comprises a pan 19 disposed facing the outlet 8 when the gluer 1 occupies the at-rest position and serving thus to catch the adhesive substance discharged when the nozzle is purged.

The pan 19 is connected to a relative supporting structure 20 associated rigidly with the packaging machine (not illustrated) by means of magnetic elements 21, in such a way that it can be removed swiftly when filled with the adhesive substance and replaced immediately with an empty pan 19.

The means 14 for removing the adhesive substance and the wetting pad 16 together constitute means 30 by which to clean the gluing unit 2.

Similarly, the atomizer device 18 and the feed duct 17 carrying the silicone oil, also a temporary storage tank (not illustrated) containing oil of this same type, together constitute feed means 40 by which the oil is supplied to the pad.

In operation, referring to FIG. 1, the gluer 1 is caused during a non-operating step of the cycle performed by the gluing unit 2 to rotate together with the cylindrical body 3 through the agency of the drive means (not illustrated), in the direction of the arrow denoted F1, from the active gluing position indicated by phantom lines to the at-rest position facing the cleaning station 6.

The cleaning operation, which commences as soon as the gluer 1 reaches the aforementioned at-rest position, consists in four distinct steps: a first step of removing any residues of the adhesive substance from the flat surface 11 of the cap 10 and from the end face 9 of the outlet 8, a second step of wetting the nozzle 7 with silicone oil, a third step of removing the silicone oil deposited on the nozzle 7 and on the flat surface 11, and a fourth step of purging the gluer 1.

Figure 2:
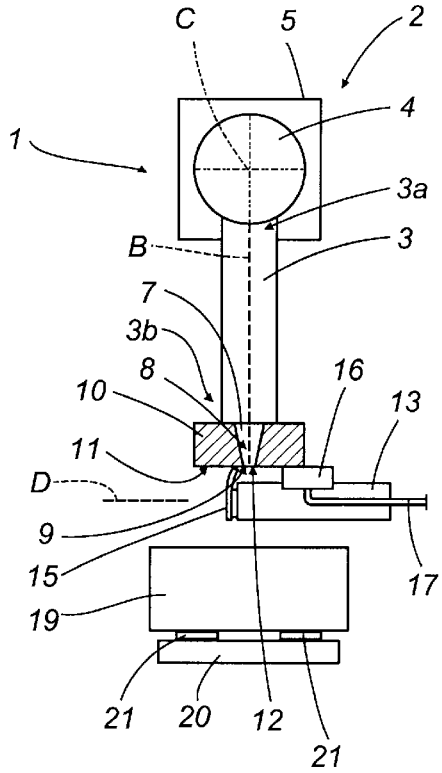
FIGS. 2, 3, 4 and 5 are respective schematic illustrations showing the gluing unit of FIG. 1 in a succession of operating steps.

Departing from the retracted and non-operating position of FIG. 1, the first movable member 13 begins moving along the path D in the direction of the arrow denoted F2 to effect the first step of the cleaning operation, as illustrated in FIG. 2, in which the scraper blade 15 carried by the first end 13*a* is caused to engage the flat surface 11 of the cap 10 and the end face 9 of the outlet 8 and thus remove any residues of the adhesive substance that may have accumulated on these parts.

During this same first step, the scraper blade 15 is able to bend, even minimally, in such a way that the outside face 15*b* appears convex and the inside face 15*a* concave, with the concave surface directed toward the first movable member 13.

The cap 10 is fashioned from a non-stick plastic material such as will prevent the aforementioned residues of adhesive substance from clinging to the flat surface 11 and thus facilitate their removal.

Residues of the adhesive substance dislodged in the course of the first removal step by the scraper blade 15 from the flat surface 11 of the cap 10 and the end face 9 of the outlet 8, are taken up onto the outside face 15*b* of the scraper blade 15 and able to run off freely as the blade is fashioned advantageously from non-stick material.

Figure 3:
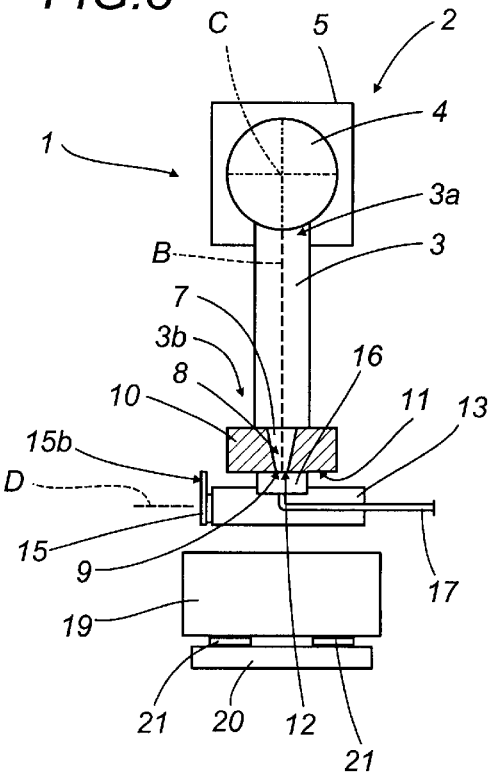

With reference to FIG. 3, which illustrates the aforementioned second step of wetting the nozzle 7, the first movable member 13 advances further along the path D to the point of placing the pad 16 in front of and in contact with the nozzle 7. During this second step, the wetting pad 16 is kept in the position of contact with the nozzle 7, occluding the outlet 8, and dampened with aerated silicone oil received by way of the feed duct 17 from the atomizer device 18, to the end of maintaining the outlet 8 suitably moist and lubricated.

Figure 4:
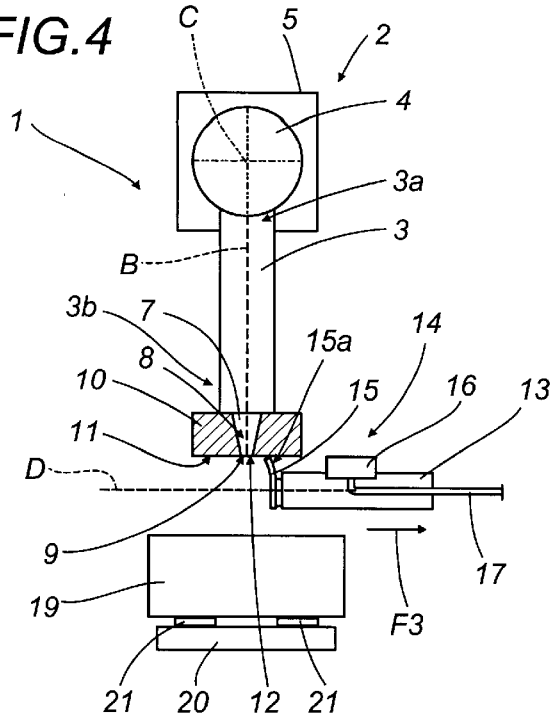

With reference to FIG. 4, which illustrates the third step of removing the silicone oil deposited on the nozzle 7 and the flat surface 11 during the second wetting step, the first movable member 13 moves back along the path D in the direction of the arrow denoted F3, away from the gluer 1, to resume the first non-operating position of FIG. 1.

During this third step, the scraper blade 15 is able to bend in the direction opposite to that of the first step, even minimally, in such a way that the outside face 15*b* appears concave and the inside face 15*a* convex, with the convex surface directed toward the first movable member 13.

As the first movable member 13 retracts in the direction of the aforementioned arrow F3 during the third step, the flat surface 11 of the cap 10 and the end face 9 of the outlet 8 are wiped by the inside face 15*a* of the scraper blade 15, and there is therefore no risk of them being fouled by the adhesive substance removed previously and picked up on the outside face 15*b* of the blade 15.

Figure 5:
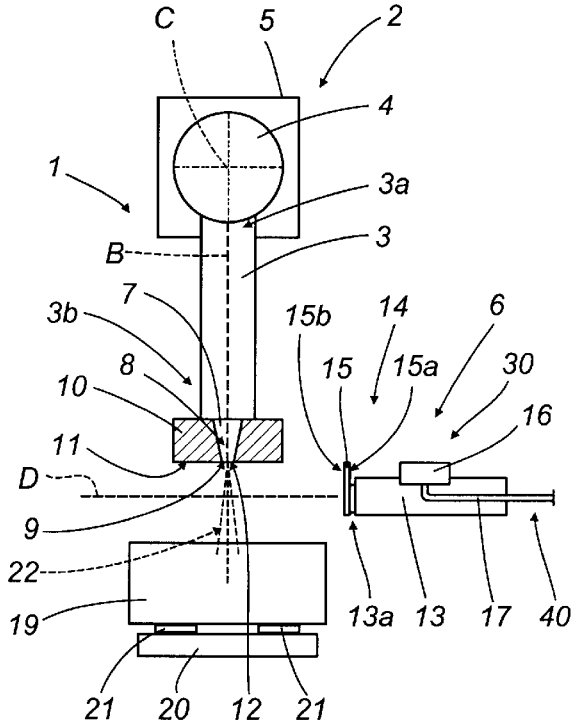

With reference to FIG. 5, which illustrates the fourth purging step 1, the first movable member 13 will remain motionless in the first non-operating position while the gluer 1, positioned with the outlet 8 directly facing the pan 19, discharges a continuous jet 22 of the adhesive substance in such a way as to simulate and restore normal operating conditions in the gluing unit following the pause.

Figure 6:
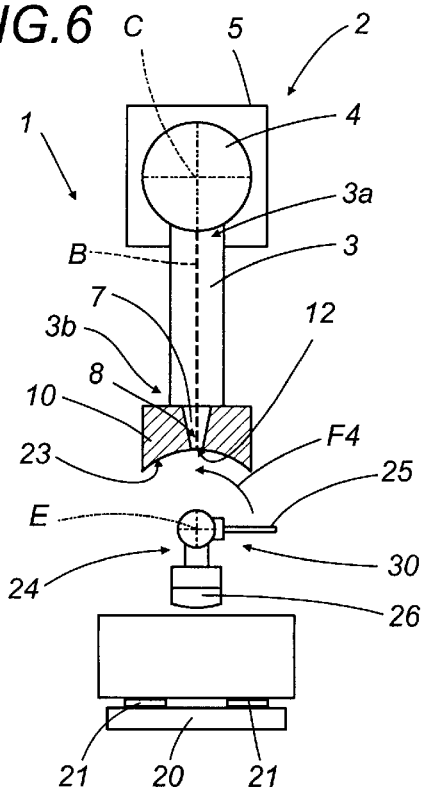
FIGS. 6, 7, 8, 9 and 10 are respective schematic illustrations showing a second embodiment of the gluing unit according to the present invention in a succession of operating steps.

FIG. 6 illustrates an alternative embodiment of the gluing unit according to the invention, wherein the cap 10 presents a smooth surface 23 of curved profile and the cleaning station 6 comprises a second movable member 24 rotatable about an axis E substantially parallel to the axis C of the rotary member 4 and perpendicular to the viewing plane.

In like manner to the first movable member 13 described previously, the second movable member 24 carries a respective scraper blade 25 and a wetting pad 26 designed to engage the curved surface 23 of the cap 10 when rotated in the direction of the arrow denoted F4, departing from the non-operating condition illustrated in FIG. 6, to the end of removing any residues of the adhesive substance from the selfsame surface 23.

Figure 7:
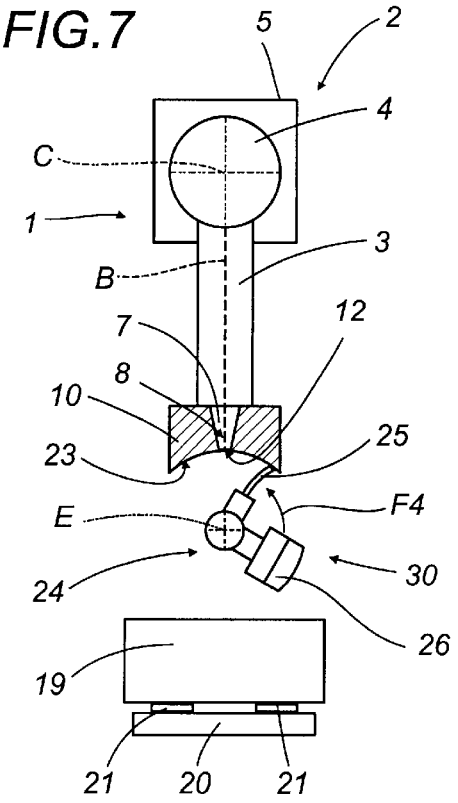
Figure 8:
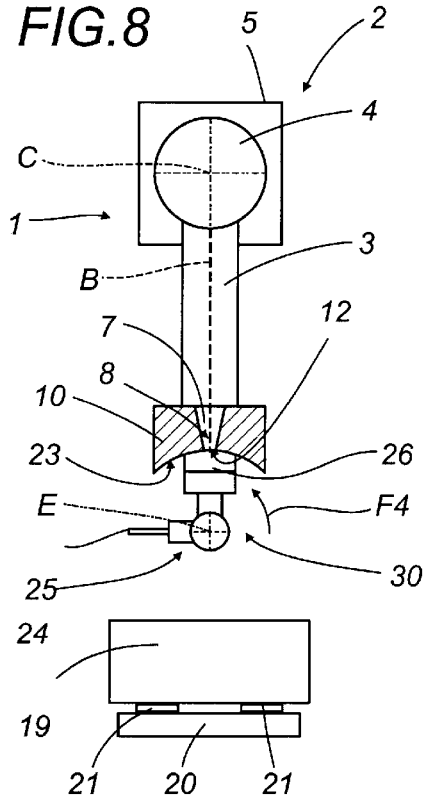
Figure 9:
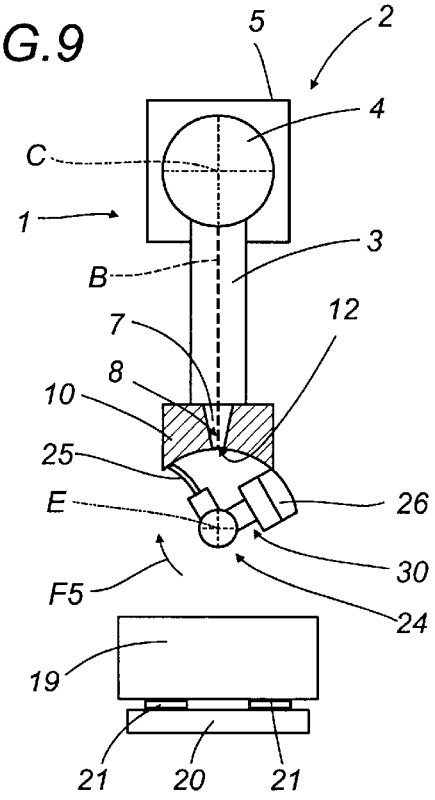
Figure 10:
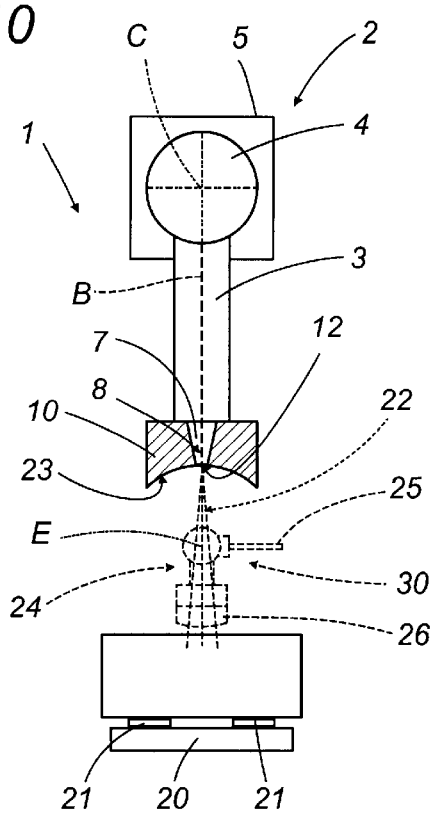

As discernible from FIGS. 7, 8, 9 and 10 and in like manner to the sequence already described, the cleaning operation consists in four distinct steps: a first step, illustrated in FIG. 7, of removing any residues of the adhesive substance from the curved surface 23 of the cap 10 and from the end face 9 of the outlet 8; a second step, illustrated in FIG. 8, of wetting the nozzle 7 with silicone oil; a third step, illustrated in FIG. 9, of removing the silicone oil from the nozzle 7 and the curved surface 23; and a fourth step, illustrated in FIG. 10, of purging the gluer 1.

It will be observed in particular that during the fourth step illustrated in FIG. 10, the second movable member 24, illustrated by phantom lines, is retracted by drive means of conventional embodiment (not illustrated) along a direction substantially parallel to the relative axis E of rotation and perpendicular to the viewing plane, in such a way that the selfsame member 24 remains clear of the jet 22 discharged into the pan 19 by the gluer 1 when purging.

Observing FIGS. 7, 8, 9 and 10, the various steps in question are implemented by rotating the second movable member 24 about the relative axis E. In particular, the second movable member 24 rotates first in the direction of the arrow denoted F4 to the point of assuming the position of FIG. 8, in which the wetting pad 26 is brought into alignment with the nozzle 7, and thereafter in the opposite direction indicated by the arrow denoted F5, so as to complete the third step of removing the silicone oil, illustrated in FIG. 9, and ultimately regain the initial angular position of FIG. 6, which is indicated by phantom lines in FIG. 10.

Figure 11:
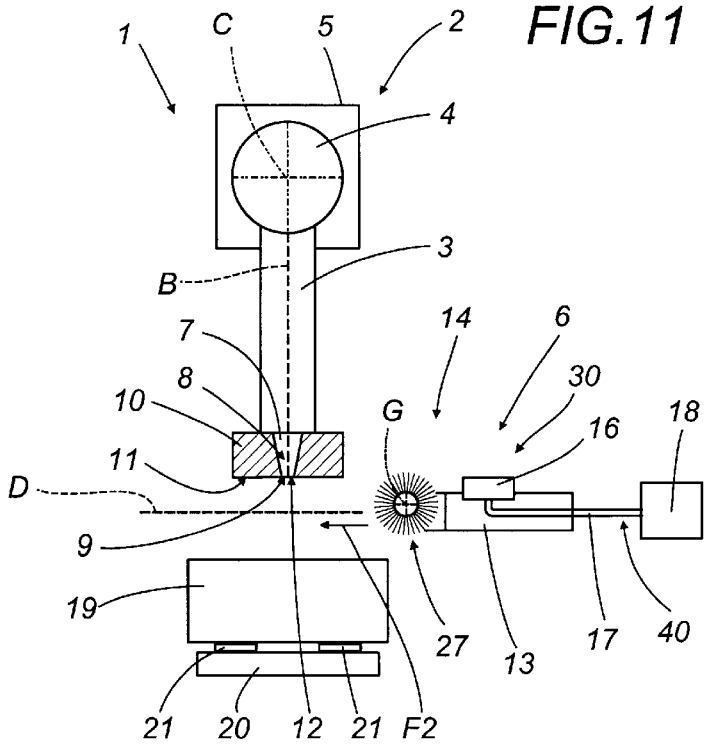
FIG. 11 is a schematic illustration showing a further embodiment of the gluing unit according to the present invention.

In the example of FIG. 11, which illustrates a further embodiment of the invention, means 14 by which the adhesive substance is removed from the cap 10 comprise a circular brush 27 mounted to the first movable member 13 and set in rotation by drive means of familiar embodiment (not indicated) about a respective axis G extending substantially perpendicular to the viewing plane.

For the cleaning operation to be accomplished to best advantage, importantly, the first movable member 13 carrying the rotary brush 27 needs to be operated in such a way that the brush 27 will make no contact with the flat surface 11 when distanced from the gluer 1 after the flat surface 11 has been wetted by the pad 16 and the nozzle 7 lubricated with silicone oil, as there would be a risk of the flat surface 11 being fouled again.

In another alternative embodiment of the present invention, not illustrated in the drawings, the gluer 1 might comprise a nozzle 7 with the cap 10 embodied integrally, in which the aforementioned surrounding flat surface and the face 9 of the outlet 8, advantageously, are one and the same.

What is claimed is:

1. A spray gluing unit in a product packaging machine, comprising at least one spray gluer equipped with a nozzle having a respective outlet from which an adhesive substance is directed at a wrapping material enveloping the products, also means by which to clean the gluing nozzle, the gluing nozzle and the cleaning means being capable of movement one relative to another for the purpose of cleaning the outlet, wherein the gluer presents a surface surrounding the outlet and joined to an end face of the self same outlet and the cleaning means comprise means by which to remove any residues of the adhesive substance, such as will interact with the end face of the outlet and with the surrounding surface at least during the relative movement of the cleaning means and the gluing nozzle; wherein the surface forms part of a cap secured to the glum nozzle and is substantially smooth.

2. A gluing unit as in claim 1, wherein the cap is substantially cylindrical and presents at least one hole shaped to fit over the outlet of the gluing nozzle in such a manner that the outlet emerges at the surface.

3. A gluing unit as in claim 1, wherein the surface is substantially flat.

4. A gluing unit as in claim 3, wherein the substantially flat surface and the end face of the outlet occupy substantially the same plane.

5. A gluing unit as in claim 1, wherein the surface is substantially curved.

6. A gluing unit as in claim 1, wherein the cap is embodied in a non-stick plastic material.

7. A gluing unit as in claim 1, wherein the means by which to remove the adhesive substance comprise a flexible scraper blade.

8. A gluing unit as in claim 7, wherein the scraper blade is embodied in a non-stick plastic material.

9. A gluing unit as in claim 1, wherein the cleaning means comprise at least one wetting pad designed to engage the outlet of the gluing nozzle.

10. A gluing unit as in claim 9, comprising feed means by which silicone oil is supplied to the wetting pad.

11. A gluing unit as in claim 10, wherein the feed means comprise a device by which the silicone oil is atomized.

12. A gluing unit as in claim 1, wherein the cleaning means are carried by a member capable of movement between a first non-operating position in which the cleaning means are distanced from the gluer and substantially inactive, and at least a second operating position in which the cleaning means are located in close proximity to the gluer so as to engage the gluer and clean the outlet.

13. A gluing unit as in claim 12, wherein the movable member makes a first translational forward movement toward the gluer, during which the surface of the cap is engaged in sequence by the scraper blade and the wetting pad, and a second translational return movement during which any residual silicone oil is removed from the selfsame surface by the scraper blade.

14. A gluing unit as in claim 12, wherein the movable member is rotatable about a relative axis at least in a first direction of rotation and in such a way that the surface of the cap is engaged in sequence by the scraper blade and by the wetting pad.

15. A gluing unit as in claim 1, wherein the means by which to remove the adhesive substance comprise a rotary brush.

16. A gluing unit as in claim 1, comprising a pan serving to catch the adhesive substance used for purging the outlet.

17. A gluing unit as in claim 16, wherein the catch pan is connected detachably to a respective supporting structure by magnetic retaining means.

18. A spray gluing unit in a product packaging machine, comprising at least one spray gluer equipped with a nozzle having a respective outlet from which an adhesive substance is directed at a wrapping material enveloping the products, also means by which to clean the gluing nozzle, the gluing nozzle and the cleaning means being capable of movement one relative to another for the purpose of cleaning the outlet, wherein the gluer presents a surface surrounding the outlet and joined to an end face of the selfsame outlet, and the cleaning means comprise means by which to remove any residues of the adhesive substance, such as will interact with the end face of the outlet and with the surrounding surface at least during the relative movement of the cleaning means and the gluing nozzle; wherein the means by which to remove the adhesive substance comprise at least one of a flexible scraper blade and a rotary brush.

19. A spray gluing unit in a product packaging machine, comprising at least one spray gluer equipped with a nozzle having a respective outlet from which an adhesive substance is directed at a wrapping material enveloping the products, also means by which to clean the gluing nozzle, the gluing nozzle and the cleaning means being capable of movement one relative to another for the purpose of cleaning the outlet, wherein the gluer presents a surface surrounding the outlet and joined to an end face of the selfsame outlet, and the cleaning means comprise means by which to remove any residues of the adhesive substance, such as will interact with the end face of the outlet and with the surrounding surface at least during the relative movement of the cleaning means and the gluing nozzle; wherein the cleaning means comprise at least one wetting pad designed to engage the outlet of the gluing nozzle; the spray gluing unit further comprising feed means comprising a device by which silicone oil is atomized and supplied to the wetting pad.

20. A spray gluing unit in a product packaging machine, comprising at least one spray gluer equipped with a nozzle having a respective outlet from which an adhesive substance is directed at a wrapping material enveloping the products, also means by which to clean the gluing nozzle, the gluing nozzle and the cleaning means being capable of movement one relative to another for the purpose of cleaning the outlet, wherein the gluer presents a surface surrounding the outlet and joined to an end face of the selfsame outlet, and the cleaning means comprise means by which to remove any residues of the adhesive substance, such as will interact with the end face of the outlet and with the surrounding surface at least during the relative movement of the cleaning means and the gluing nozzle; wherein the spray gluing unit further comprises a pan connected detachably to a respective supporting structure by magnetic retaining means and serving to catch the adhesive substance used for purging the outlet.

* * * * *